United States Patent [19]

Irland

[11] 4,308,973

[45] Jan. 5, 1982

[54] COMPARTMENTED AEROSOL CONTAINER

[75] Inventor: Lewis F. Irland, Palos Hills, Ill.

[73] Assignee: The Continental Group, Inc., New York, N.Y.

[21] Appl. No.: 921,034

[22] Filed: Jun. 30, 1978

[51] Int. Cl.[3] ..... B65D 25/14; B65D 35/28

[52] U.S. Cl. ..... 220/454; 220/85 B; 220/461; 222/95; 222/386.5

[58] Field of Search ..... 220/85 B, 456, 462, 220/461, 460, 457, 454, 66, 67; 222/386.5, 95, 131; 229/53, 55, 3.5 R; 156/69; 113/120 A

[56] References Cited

U.S. PATENT DOCUMENTS

| | | | |
|---|---|---|---|
| 1,575,666 | 3/1926 | Warner | 220/462 |
| 2,110,612 | 3/1938 | Skinner et al. | 220/463 X |
| 2,919,059 | 12/1959 | Sporka | 229/3.5 R |
| 2,973,116 | 2/1961 | Roberge | 220/456 X |
| 3,323,206 | 6/1967 | Clark | 222/95 |
| 3,408,731 | 11/1968 | Mercier | 220/67 X |
| 3,471,349 | 10/1969 | Cohen et al. | 222/386.5 X |
| 3,622,439 | 11/1971 | Manne et al. | 229/3.5 R |
| 3,700,136 | 10/1972 | Ruekberg | 220/66 X |
| 3,880,326 | 4/1975 | Kennard et al. | 222/95 |
| 3,936,334 | 2/1976 | Kushida et al. | 222/95 X |
| 4,008,830 | 2/1977 | Meshberg | 222/95 |
| 4,095,724 | 6/1978 | Perusco | 222/95 |

FOREIGN PATENT DOCUMENTS

| | | | |
|---|---|---|---|
| 960192 | 12/1974 | Canada | 222/95 |

*Primary Examiner*—Allan N. Shoap
*Attorney, Agent, or Firm*—Charles E. Brown

[57] ABSTRACT

A compartmented aerosol container wherein an open ended container body has disposed therein a pouch which is bonded to the container body adjacent the open end thereof in sealed relation. The pouch receives the product to be dispensed and defines a first compartment. A second compartment is formed outside of the pouch and within the container body for receiving a suitable propellant.

6 Claims, 6 Drawing Figures

COMPARTMENTED AEROSOL CONTAINER

This invention relates in general to new and useful improvements in containers, and more specifically to an improved aerosol container.

Environmental and economic considerations have caused the aerosol industry to search for techniques that will permit elimination of fluorocarbon propellants from aerosol containers. The difficulty encountered resides primarily in compartmenting the container so that the product to be dispensed is separated from the propellant with the divider between the compartments providing an adequate barrier to both the propellant and the intended product.

In accordance with this invention, it is proposed to provide an economically feasible plastic pouch which is preferably formed of a laminate having sufficient strength and barrier properties. It has been found that a suitable laminate includes polypropylene outer layers and at least one inner layer of saran.

Having first formed a suitable pouch of the above described laminate, it has been found desirable directly to bond the open end portion of such pouch to the open upper end of a container body independently of any seam between the upper end of the container and the container body. The bond between the pouch and the interior of the container body must effect a complete seal between the two compartments defined by the pouch within the container body.

It has also been found that the upper end unit may project down into the interior of the upper portion of the container body and engage the adhesive bonding the pouch to the container body to form a seal therewith.

Another improvement of the invention is the internal coating of the upper end unit to provide necessary product protection.

Finally, the pouch may be bonded to the interior of the container body utilizing a suitable adhesive which may be applied in the form of a powder or in a dispersion suitable for roll application. The adhesive may be activated by indication or conduction heating as well as by sonic means.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
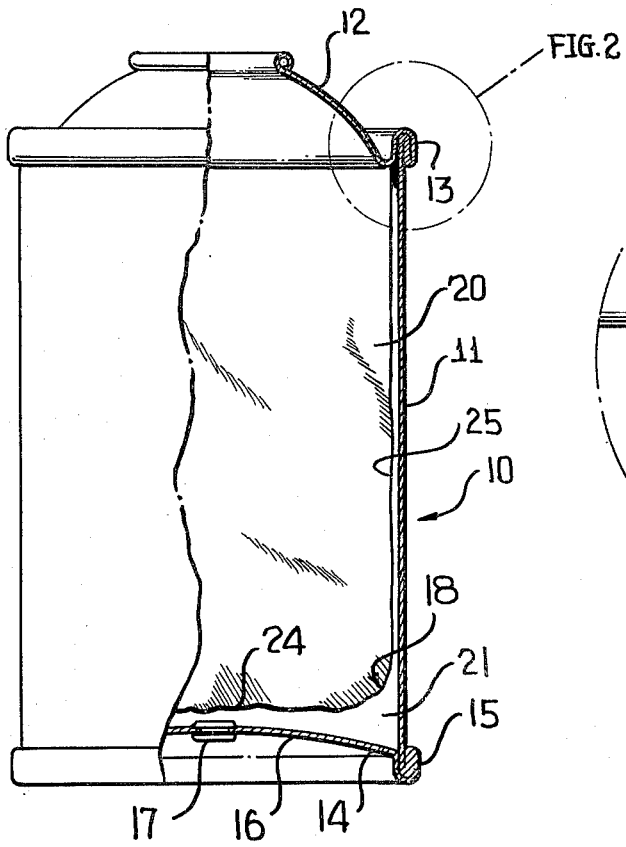
FIG. 1 is a side elevational view of a two-compartment aerosol can formed in accordance with this invention, a portion of the can and pouch being broken away and shown in section.

Referring now to the drawings in detail, it will be seen that there is illustrated in FIG. 1 a two-compartment aerosol container formed in accordance with this invention, the container being generally identified by the numeral 10. Conveniently, the container 10 includes a conventional can body 11 having secured to the upper end thereof a standard domed aerosol end unit 12 by way of a conventional double seam 13. The lower end of the container body 11 is closed by a conventional aerosol bottom end unit 14 which is secured to the body 11 by means of a second double seam 15. The end unit 14 has a recessed end panel 16 which carries a conventional charging valve 17.

It is to be noted that the container 10 is distinguished from conventional aerosol cans in that it is divided interiorly into two compartments by means of a pouch, generally identified by the numeral 18. A first compartment 20 is formed within the pouch 18 and is intended to receive a product to be dispensed. A second compartment 21 is formed exteriorly of the pouch 18 and within the container. The second compartment 21 is intended to be internally pressurized by means of a suitable propellant introduced therein through the charging valve 17.

Figure 2:
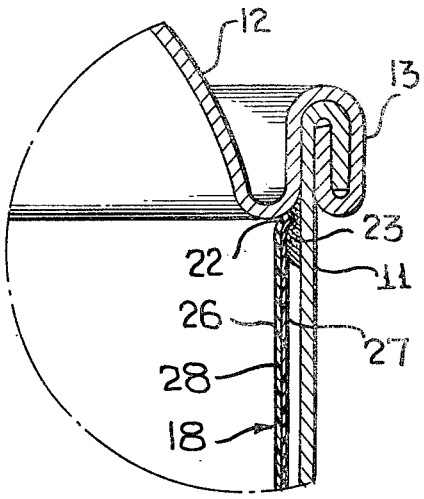
FIG. 2 is an enlarged fragmentary vertical sectional view of the area encircled in FIG. 1, and referred to as FIG 2.

Referring now to FIG. 2 in particular, it will be seen that the pouch 18, which has an open upper end 22, is bonded directly to the interior of the body 11 and is sealed relative thereto by means of adhesive 23. It is also to be noted that the adhesive 23 is so positioned that when the end unit 12 is applied, the inner portion of the end unit 12 telescopes down into the body 11 and forms a further seal either with the pouch or the adhesive, or both.

The pouch 18, as best shown in FIG. 1, includes a bottom wall 24 and a generally cylindrical body 25. The construction of the pouch 18 may vary. It is, however, necessary that the pouch have physical characteristics so as to not only withstand the pressures developed by the propellant, but also have barrier properties preventing the propellant from mixing with the product.

Referring once again to FIG. 2, it will be seen that the pouch 18 is of a laminated construction. Most particularly, the pouch 18 includes polypropylene outer layers 26, 27 and a saran intermediate layer 28. The three layers are suitably bonded together. It is also not the intention of applicant to exclude any further desired intermediate layers.

It has been found that if the saran layer has a thickness on the order of 2 mils, the saran should provide an adequate barrier against mixing of the propellant and the product without undue expense. The polypropylene layers provide the necessary strength and also have the necessary physical properties for direct contact with both the product to be dispensed and the propellant which may be used.

Figure 3:
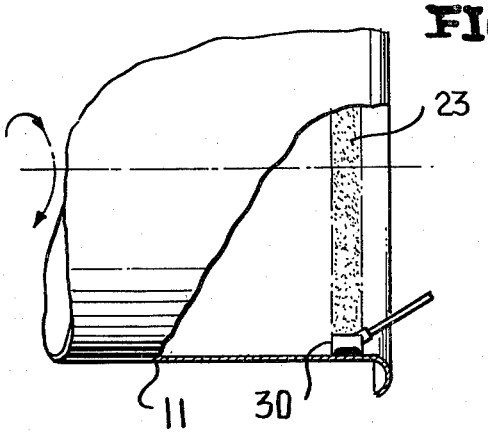
FIG. 3 is a fragmentary schematic view showing the manner in which the adhesive may be applied to the interior of the container body by means of a suitable roll.

Referring now to FIG. 3, it will be seen that the adhesive 23 is applied by means of a roll 30. The adhesive is preferably applied in the form of a powder or in a dispersion suitable for roll application. The adhesive 23 may vary, but it is necessary that it be of a type which is heat activated.

Figure 4:
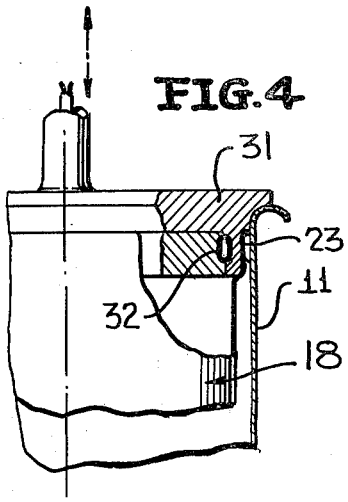
FIG. 4 is a schematic sectional view showing the manner in which the pouch is pressed into engagement with the adhesive and thereafter activated by heating.

After the adhesive 23 has been applied to the can body 11, the pouch 18 is telescoped thereinto through the open upper end and a mouth portion of the pouch 18 is fully opened and suitably clamped against the adhesive 23 in the manner shown in FIG. 4 with the free end of the pouch turned outwardly to be embedded in the adhesive as shown in FIG. 2. It is to be understood that the mouth of the pouch 18 may be clamped in place by any suitable clamping element and the invention is not restricted to the use of the plug member 31 illustrated in FIG. 4.

The plug member 31 is illustrated as carrying a heating element 32. At this time it is envisioned that the adhesive 23 may be activated not only by conduction heating, but also induction heating and sonic energy.

Figure 5:
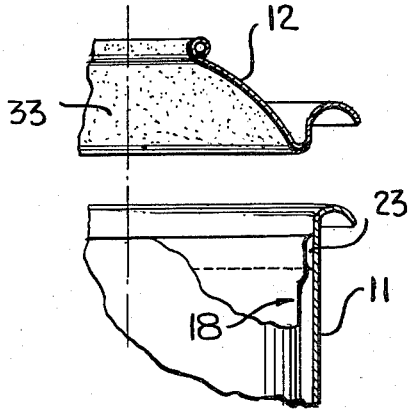
FIG. 5 is a fragmentary elevational view with parts broken away in section, and showing the addition of a domed upper end unit to the combined can body and pouch.

After the pouch 18 has been bonded to the interior of the can body 11, the end unit 12 is applied in a conventional seaming operation. As shown in FIG. 5, the end unit 12 may be internally coated by application of a suitable coating 33 which is preferably applied in powder form.

Figure 6:
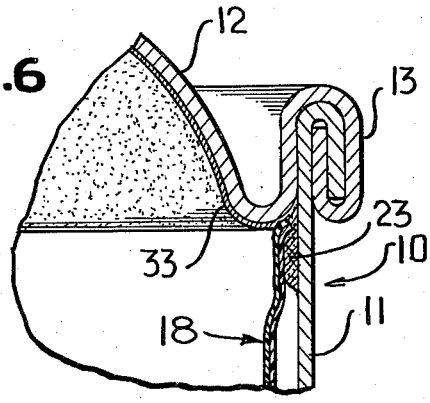
FIG. 6 is a fragmentary sectional view on an enlarged scale similar to FIG. 2, but showing the end unit as having an internal coating.

It is to be understood that the adhesive will be applied in sufficient quantity so that no portion of the interior of the container 10 will be exposed to the product if this is so desired. In FIG. 6 the coating 33 is shown as being in direct contact with the pouch 18 and the excess adhesive 23.

Although only a preferred embodiment of the compartmented aerosol container has been specifically illustrated and described herein, it is to be understood that the construction of the container per se and the pouch may be varied without departing from the spirit and scope of the invention as defined by the appended claims.

I claim:

1. A compartmented aerosol container comprising a tubular container body having an open upper end, a plastic pouch having a closed lower end and an open upper end, said plastic pouch being telescoped within said container body with said plastic pouch upper end being disposed adjacent said container upper end in recessed relation thereto, and a sealed bond between the exterior of said plastic pouch at said plastic pouch upper end and the interior of said container body, said plastic pouch defining a first compartment for a product, and said container body in conjunction with said plastic pouch defining a second compartment for a propellant, said bond being in the form of an applied adhesive on the interior of said container body, said container body having the open upper end thereof closed by an end unit, and said end unit being in sealed contact with said adhesive.

2. The aerosol container of claim 1 wherein said end unit has a protective internal coating sealed relative to said adhesive.

3. The aerosol container of claim 1 wherein said end unit has an intermediate annular portion depending into said container body upper end immediately adjacent said container body, and said end unit annular portion being directly engaged with said plastic pouch upper end.

4. A compartmented aerosol container comprising a tubular container body having an open upper end, a plastic pouch having a closed lower end and an open upper end, said plastic pouch being telescoped within said container body with said plastic pouch upper end being disposed adjacent said container upper end in recessed relation thereto, and a sealed bond between the exterior of said plastic pouch at said plastic pouch upper end and the interior of said container body, said plastic pouch defining a first compartment for a product, and said container body in conjunction with said plastic pouch defining a second compartment for a propellant, said plastic pouch being of a laminated construction and including polypropylene outer layers and a saran inner layer.

5. A compartmented aerosol container comprising a tubular container body having an open upper end, a plastic pouch having a closed lower end an an open upper end, said plastic pouch being telescoped within said container body with said plastic pouch upper end being disposed adjacent said container upper end in recessed relation thereto, and a sealed bond between the exterior of said plastic pouch at said plastic pouch upper end and the interior of said container body, said plastic pouch defining a first compartment for a product, and said container body in conjunction with said plastic pouch defining a second compartment for a propellant, said bond being in the form of an applied adhesive on the interior of said container body, said adhesive being in the form of an annular stripe having a width extending axially of said container body and above said plastic pouch upper end, and said plastic pouch upper end being generally outwardly turned and being embedded in said annular adhesive stripe.

6. A compartmented aerosol container comprising a tubular container body having an open upper end, a plastic pouch having a closed lower end and an open upper end, said plastic pouch being telescoped within said container body with said plastic pouch upper end being disposed adjacent said container upper end in recessed relation thereto, and a sealed bond between the exterior of said plastic pouch at said plastic pouch upper end and the interior of said container body, said plastic pouch defining a first compartment for a product, and said container body in conjunction with said plastic pouch defining a second compartment for a propellant, said container body having the open upper end thereof closed by an end unit, said end unit having an intermediate annular portion depending into said container body upper end immediately adjacent said container body, and said end unit annular portion being directly engaged with said plastic pouch upper end.

* * * * *